US007495031B2

(12) United States Patent
Sakuma et al.

(10) Patent No.: US 7,495,031 B2
(45) Date of Patent: Feb. 24, 2009

(54) PROCESS FOR PRODUCING AN EMULSION

(75) Inventors: Yasumitsu Sakuma, Wakayama (JP); Tatsuya Horibata, Wakayama (JP); Kazuhito Miyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 399 days.

(21) Appl. No.: 11/060,569

(22) Filed: Feb. 18, 2005

(65) Prior Publication Data

US 2005/0197271 A1 Sep. 8, 2005

(30) Foreign Application Priority Data

Feb. 24, 2004 (JP) ..... 2004-048273

(51) Int. Cl.

| | |
|---|---|
| ***B01F 3/08*** | (2006.01) |
| ***B01F 17/52*** | (2006.01) |
| ***C11D 3/08*** | (2006.01) |
| ***C11D 11/00*** | (2006.01) |
| ***C11D 17/08*** | (2006.01) |
| ***C11D 3/10*** | (2006.01) |
| *B01F 3/12* | (2006.01) |

(52) U.S. Cl. ..... 516/53; 510/417; 510/476; 510/238; 510/507; 510/509; 516/900

(58) Field of Classification Search ..... 516/53, 516/900; 510/417, 476, 238, 507, 509
See application file for complete search history.

(56) References Cited

U.S. PATENT DOCUMENTS 3,520,818 A * 7/1970 Cambre ..... 510/398
4,018,720 A * 4/1977 Lengyel et al. ..... 252/179
4,107,067 A * 8/1978 Murphy et al. ..... 516/900
4,347,151 A * 8/1982 Lohr et al. ..... 510/398

FOREIGN PATENT DOCUMENTS

| | | | |
|---|---|---|---|
| CH | 505 198 | * | 3/1971 |
| EP | 1 568 761 A1 | * | 8/2005 |
| JP | 6-80998 | | 3/1994 |

OTHER PUBLICATIONS

Hawley's Condensed Chemical Dictionary, Eleventh Edition, edited by Sax and Lewis, Sr. (Van Nostrand Reinhold Company, New York, NY, copyright 1987), 10-1989, p. 1024.*

Derwent Abstract on EAST, week 197835, London: Derwent Publications Ltd., AN 1968-07640Q, CH 505 198 A, (The Procter & Gamble Co), abstract, pp. 1-3.*

PCT application European Search Report, EP 05 00 3895, (Jun. 2005), IB The Hague, NL, pp. 1-3.*

* cited by examiner

*Primary Examiner*—Daniel S Metzmaier
(74) *Attorney, Agent, or Firm*—Oblon, Spivak, McClelland, Maier & Neustadt, P.C.

(57) ABSTRACT

A process for producing an emulsion, including adding a mixture (1) comprising a water-soluble inorganic salt (a) and/or an aqueous solution containing (a) to a mixture (2) containing a surfactant (b), a surfactant-emulsifying agent (c) for emulsifying the surfactant (b), and a hydrophilic powder (d), and mixing mixtures (1) and (2) to emulsify the surfactant (b), wherein water-soluble inorganic salt (a) may be a carbonate, surfactant (b) may be an anionic surfactant and/or a nonionic surfactant, surfactant-emulsifying agent (c) may be a water-soluble polymer, and hydrophilic powder (d) may be an inorganic chelating agent.

10 Claims, No Drawings

PROCESS FOR PRODUCING AN EMULSION

FIELD OF THE INVENTION

The present invention relates to a process for producing an emulsion and in particular to a process for producing an emulsion, for example, for a liquid detergent, which is useful in various fields such as a washing detergent, a kitchen detergent, a household detergent and a detergent for cleaning various hard surfaces.

BACKGROUND OF THE INVENTION

Generally, a liquid detergent composition containing a surfactant, particularly a nonionic surfactant, is desirably blended with an alkali and a calcium-sequestering agent to improve washing effect. However, such surfactant is poor in compatibility with an aqueous solution containing an electrolytic salt at high concentration such as in concentrated alkali water, and is hardly stably blended.

In recent years, techniques solving this problem by emulsifying a nonionic surfactant, at a high concentration of an electrolyte, in the presence of an emulsifier such as a water-soluble polymer have been reported (JP-A 6-80998).

Usually, the emulsion is produced by a process wherein a mixture separated into an oily phase and an aqueous phase is emulsified with an emulsifying machine in a batch system such as a homo mixer or with an emulsifier in a continuous system such as a line mixer, or an oily phase is added to an aqueous phase forming a continuous phase and then emulsified with the same emulsifying machine.

On the other hand, the maintenance of the emulsifying machine in the continuous system arranged in a piping outside of a bath is improved as compared with the batch system, but there is a problem in burden (e.g. abrasion) on facilities and in productivity.

To solve these problems, JP-A 6-80998 supra describes an emulsifying method wherein a dispersion having an emulsifying polymer and a nonionic surfactant mixed in water is added under sufficient stirring at a relatively low rate of about 400 rpm with a propeller stirrer, and then a water-soluble inorganic salt is added to, and mixed with, the dispersion while stirring.

SUMMARY OF THE INVENTION

The invention provides a process for producing an emulsion, including the steps of adding a mixture (1) comprising a water-soluble inorganic salt (a) and/or an aqueous solution containing the water-soluble inorganic salt (a) to a mixture (2) containing a surfactant (b), a surfactant-emulsifying agent (c) for emulsifying the surfactant (b), and a hydrophilic powder (d), and mixing mixtures (1) and (2) to emulsify the surfactant (b).

The invention also provides an emulsion obtained by the above shown process, wherein the emulsion is for a detergent.

The invention also provides use of the emulsion obtained by the above shown process for a detergent.

DETAILED DESCRIPTION OF THE INVENTION

In the emulsified composition of JP-A 6-80998, however, it is necessary that emulsified liquid droplets be micronized from the viewpoint of liquid droplets (oil phase) containing the surfactant changed oily by salting-out and an aqueous solution phase (aqueous phase) containing the electrolyte at a high concentration be prevented from being separated from each other due to a difference in specific gravity therebetween and reducing the particle diameter distribution of the emulsified liquid droplets and reducing the viscosity of the emulsion.

However, the batch system has a problem that when the batch size is increased in view of improvement in productivity, the burden on facilities is significantly increased, and when a powder of a calcium-sequestering agent, etc. is compounded, the stirring blade of the emulsifying machine is easily worn. In addition, there is also the problem of reduction in productivity because as the amount of the mixture to be treated is increased, the treatment time necessary for attaining the same diameter of emulsified liquid droplets is increased.

In JP-A 6-80998, there are problems such as a large diameter of the resulting emulsified liquid droplets and a high viscosity of the resulting emulsion.

When a mixture separated into an oily phase and an aqueous phase advances with the mechanical stirring force applied upon passage through a stirring blade, the micronization of emulsified liquid droplets advances with an emulsifying machine. And the liquid droplets have a broad particle diameter distribution from droplets having a large particle diameter to droplets of having a small particle diameter in the initial stage of stirring, and the micronization of the liquid droplets depends on the extent to which the blended solution is contacted with the stirring blade. That is, when the mechanical stirring force is the same, the stirring time necessary for attaining the same particle-diameter distribution of liquid droplets is increased as the amount of the blended solution is increased. Further, the micronization of liquid droplets depends considerably on the shearing force applied to the liquid droplets, and fine liquid droplets cannot be obtained at a low stirring peripheral speed even by stirring for a long time, and thus the stirring peripheral speed should be increased.

The present invention relates to a process for producing a stable emulsion easily.

The present invention provides a process for producing an emulsion having fine liquid droplets capable of significantly reducing a burden on facilities.

Although not wanting to be limited by theory, in the present invention, as the water-soluble inorganic salt (a) is added to an aqueous solution of the surfactant (b), at a low concentration of an electrolyte, containing hydrophilic powder (d) in a granular form, an aqueous solution containing the water-soluble inorganic salt (a) is discharged from the aqueous solution of the surfactant (b) and dispersed as water droplets, and the hydrophilic powder (d) is concentrated in the water droplets containing the water-soluble inorganic salt (a). As the water-soluble inorganic salt (a) is further added, the discharge of water from the aqueous solution of the surfactant (b) advances to provide an emulsion containing the water-soluble inorganic salt (a)-containing water droplets as a continuous phase with the surfactant (b) as oil droplets. In this case, the hydrophilic powder (d) concentrated in the water droplets containing the water-soluble inorganic salt (a) is formed into a continuous phase thereby allowing the hydrophilic powder (d) to be uniformly dispersed in the system, and this dispersing force is estimated to effectively transfer the stirring force applied for micronization of the oil droplets. It follows that as compared with the same stirring conditions in the absence of the hydrophilic powder (d), micronization into significantly fine emulsified liquid droplets is feasible, and sufficient micronization of the emulsified liquid droplets can be realized even under low-stirring conditions. Under high-stirring conditions, the emulsion can be produced in a shorter time.

Particularly, it is effective to conduct stirring in such a concentration range of the water-soluble inorganic salt (a) as to be suitable for the progress of emulsification. At a concentration outside the range, lower or higher, such an influence by stirring is small. In other words, at a concentration being outside such a concentration range of the water-soluble inorganic salt (a) as to be suitable for the progress of emulsification, the influence by the stirring conditions and the adding rate of the water-soluble inorganic salt (a) is so small that the water-soluble inorganic salt (a) may be added at an arbitrary rate. The emulsion of the invention can be therefore produced very productively, even when the compounding scale is increased.

According to the present invention, an emulsion having the same fine liquid droplets as those produced by an emulsifying machine can be produced by using only a general bath stirrer.

[Water-Soluble Inorganic Salt (a)]

The water-soluble inorganic salt (a) used in the present invention is not particularly limited insofar as it is capable of salting out the surfactant (b) dissolved in an aqueous solution, but is preferably an alkali metal sulfate, an alkali metal carbonate or an ammonium or alkyl ammonium chloride or bromide. In considering the case where the emulsion is used as a detergent, an alkali metal carbonate or an alkali metal silicate is preferable in respect of detergency, and the alkali metal is preferably sodium or potassium.

[Surfactant (b)]

The surfactant (b) used in the present invention is not particularly limited insofar as it has a hydrophilic group and a hydrophobic group, and is partially or wholly salted out by addition of the water-soluble inorganic salt. An anionic surfactant and a nonionic surfactant are particularly preferably contained for use in detergent.

Preferable examples of the anionic surfactant include an alkyl benzene sulfonate having an alkyl group containing 10 to 20 carbon atoms on average, an alkyl ether sulfate having ethylene oxide added to a linear or branched higher alcohol containing 10 to 20 carbon atoms on average, an alkyl or alkenyl sulfate having an alkyl or alkenyl group containing 10 to 20 carbon atoms on average, a branched alkyl sulfate, and a fatty acid salt containing 8 to 20 carbon atoms on average.

The counterion of the anionic surfactant. can be selected from cations such as sodium, potassium, magnesium, calcium and alkanolamine and a mixture thereof. The counterion may be monomethyl diethanol amine or dimethyl monoethanol amine.

As the nonionic surfactant, known nonionic surfactants described in "Chapter 3-1. Collection of Known/Customary Techniques (Powdery Detergent for Clothing)" can be used. Examples include polyethylene oxide and/or polypropylene oxide-based nonionic surfactants such as polyoxyethylene alkyl ether having about 5 to 20 moles of ethylene oxide added to a C8 to C18 linear or branched primary or secondary alcohol, polyoxyethylene polyoxypropylene alkyl ether having about 5 to 15 moles of ethylene oxide and about 1 to 5 moles of propylene oxide added to the above alcohol, etc., polyethylene alkyl phenyl ethers, N-polyoxyethylene alkyl amine, sucrose fatty esters, fatty acid glycerin monoesters, higher fatty acid alkanol amides, polyoxyethylene higher fatty acid alkanol amides, amine oxides, alkyl glycosides, alkyl glyceryl ethers and N-alkyl glucone amides, etc.

[Surfactant-Emulsifying Agent (c)]

The surfactant-emulsifying agent (c) used in the present invention is not particularly limited insofar as it can emulsify the surfactant, which was salted out. Whether the surfactant has been emulsified with the emulsifying agent (c) in the present invention can be confirmed by the following test method.

A composition containing 20 weight % (as effective content of the surfactant, 30 weight % potassium carbonate, 5 weight % (as effective content) of the emulsifying agent (c) and water (balance) is introduced into a transparent sample bottle. The. sample bottle is shut with a lid, then shaken for 1 minute vigorously using hands under the condition at room temperature (25° C.) and left at room temperature for 3 minutes. When the emulsifying agent (c) in the present invention is used, the mixture still remains opaque as a whole in an emulsified state, but when an agent not emulsifying the surfactant is added, the mixture turns from an opaque state to a paler state and initiates phase separation into an upper layer and a lower layer.

As the emulsifying agent (c) which can preferably emulsify the surfactant, a water-soluble polymer is preferable because of excellent emulsification stability. The "water-soluble" polymer refers to one that dissolves in an amount of at least 1 g/L in ion-exchange water at 25° C.

The weight-average molecular weight of the preferable water-soluble polymer is 2,000 to 8,000,000, more preferably 2,000 to 7,000,000, even more preferably 3,000 to 6,000,000, and even more preferably 5,000 to 6,000,000. This weight-average molecular weight is a polyethylene glycol (PEG)-equivalent average molecular weight determined by gel permeation chromatography (GPC).

With respect to stability, it is preferable that the water-soluble polymer is dissolved even in an aqueous phase (hereinafter referred to simply as aqueous phase) when the water-soluble inorganic salt (a) has been added thereto. A polymer having a function of stably maintaining the state where liquid droplets, principally including the surfactant (b)salted out, are dispersed in the emulsion is preferable. Any polymer having such function can be preferably used. The polymer having such function includes, for example, polymers having a structural unit (A) derived from a monomer having affinity for the aqueous phase and/or a structural unit(B) derived from a monomer having affinity for the salted-out surfactant, wherein the ratio by weight of structural unit (A) to structural unit (B), that is, (A)/(B), is 30/70 to 90/10 (this polymer is referred to hereinafter as type 1), (A)/(B) is 100/0 to 95/5 (this polymer is referred to hereinafter as type 2), or (A)/(B) is 5/95 to 0/100 (this polymer is referred to hereinafter as type 3). Among these polymers, type 1 and type 2 polymers are preferable with respect to stability and solubility, and the type 1 polymer is particularly preferable.

Structural unit (A) is preferably a polymer chain having an anionic group or its salt in a structural unit, more preferably a polymer chain having a carboxy group or its salt in a structural unit, wherein a sulfonic acid group, a phosphoric acid group, a phosphonic acid group or a salt thereof maybe contained. Structural unit (B) is preferably a nonionic polymer chain or an organic group.

Preferable examples of a type 1 polymer include the following polymers among which polymers in 1 and 6 are particularly preferable.

1. A copolymer of an ester (preferably monoester) between polyalkylene glycol and a vinyl monomer having a carboxy group or its salt.

A copolymer of polyalkylene glycol (meth)acrylate and a vinyl monomer having a carboxy group or its salt is more preferable, and a copolymer of polyalkylene glycol (meth) acrylate and (meth)acrylic acid or its salt is particularly preferable. Preferable examples include a copolymer of polyethylene glycol mono(meth)acrylate and (meth)acrylic acid or its salt, a copolymer of poly(ethylene glycol/propylene glycol)mono(meth)acrylate and (meth) acrylic acid or its salt.

2. A copolymer of polyalkylene glycol ether having a reactive unsaturated group (radical-polymerizable unsaturated group) and a vinyl monomer having a carboxy group or its salt.

A copolymer of a polyalkylene glycol ether having a reactive unsaturated group and a monomer based on (meth) acrylic acid or its salt and/or maleic acid is preferable. For example, mention is made of a copolymer of polyethylene glycol allyl ether and maleic acid (or its salt).

3. A copolymer having a carboxyl-containing monomer or its salt grafted onto polyalkylene glycol Preferable examples include graft polymers obtained by radical-polymerizing acrylic acid with maleic acid or a salt thereof in polyethylene glycol, polypropylene glycol or poly (ethylene glycol/propylene glycol).

4. A (co)polymer of vinyl monomers having a carboxy group or its salt by using a polyalkylene glycol macroazo initiator Preferable examples include block polymers obtained by radical-polymerizing (meth)acrylic acid or its salt.

5. A graft polymer obtained by linking polyalkylene glycol having a hydroxyl group at the terminus thereof with a polymer of vinyl monomers having a carboxy group or its salt by dehydration reaction Preferable examples include graft polymers obtained by linking polyethylene glycol having a hydroxyl group at the terminus thereof with poly(meth)acrylic acid or its salt by dehydration reaction.

6. A copolymer of a vinyl monomer having a carboxy group or its salt and a vinyl monomer having a C8 to C30 hydrocarbon group Preferable examples include a copolymer of (meth) acrylic acid or its salt and (meth)acrylate having a C8 to C30 alkyl group.

The type 2 polymer is preferably a polymer dissolved uniformly in an aqueous phase but not uniformly dissolved in liquid droplets. Preferable examples of type 2 polymers include a (co)polymer of a vinyl monomer having a carboxy group or its salt and/or a vinyl monomer having a sulfonic acid group or its salt, for example (co)polymers of acrylic acid and/or its salt, methacrylic acid and/or its salt, styrenesulfonic acid and/or its salt, 2-acrylamide-2-methyl propane sulfonic acid and/or its salt, (meth)allylsulfonic acid and/or its salt.

The type 3 polymer is preferably a polymer wherein Segment (B) has a polymer chain having an alkylene oxy group as a structural unit, and is preferably uniformly dissolved in liquid droplets but not uniformly dissolved in an aqueous phase. Preferable examples of type 3 polymers include polyalkylene glycols such as polyethylene glycol and polypropylene glycol.

[Hydrophilic Powder (d)]

The hydrophilic powder (d) used in the present invention includes not only the one whose particles themselves are hydrophilic but also the one whose particles are rendered hydrophilic thereon by some treatment. The hydrophilic powder (d) may be the one which is used so as to be present as particles in the mixture (2), and is preferably the one which has difficultly being soluble in the mixture (2) or, upon addition in an amount higher than solubility, is inherently dispersed in the aqueous phase.

From the viewpoint of preventing sedimentation upon suspension in an emulsion, the particle diameter of the hydrophilic powder (d) is preferably 20 μm or less in terms of the diameter of secondarily agglomerated particles. The particle diameter is preferably 1 μm or more from the viewpoint of effectively micronizing the emulsified liquid droplets.

In considering the case where the emulsion is used as a detergent, the preferable hydrophilic powder (d) can use an inorganic chelating agent such as tripolyphosphate and zeolite. This inorganic chelating agent is preferably a chelating agent having a molecular weight of 1000 or less, a scavenged calcium amount of 200 to 600 $CaCO_3$ mg/g and a calcium stabilization constant of 2 to 10.

[Process for Producing the Emulsion]

In the present invention, a mixture (1) of a water-soluble-inorganic salt (a) and/or an aqueous solution containing the same is added to, and mixed with, a mixture (2) containing a surfactant (b), a surfactant-emulsifying agent (c) and a hydrophilic powder (d), thereby giving an emulsion having the surfactant (b) emulsified therein.

From the viewpoint of the stability of the emulsion, the content of the water-soluble inorganic salt (a) in the aqueous solution (mixture (1)), though varying depending on the oil-phase composition and the type of the surfactant (b), is preferably 4 to 50 weight %, more preferably 5 to 32 weight %, even more preferably 6 to 20 weight %, based on the total amount of the emulsion. The content of the surfactant (b) in the mixture (2), from the viewpoint of applying as a detergent, is preferably 5 to 80 weight %, more preferably 10 to 60 weight %, even more preferably 20 to 60 weight %, based on the total amount of the emulsion. From the viewpoint of stability of the emulsion, the content of the emulsifying agent (c) in the mixture (2) is preferably 0.01 to 10 weight %, more preferably 0.1 to 5 weight %, based on the total amount of the emulsion. From the viewpoint of efficiently producing an emulsion having fine liquid droplets and preventing thickening, the content of the hydrophilic powder (d) in the mixture (2) is preferably 5 to 50 weight %, more preferably 10 to 40 weight %, based on the total amount of the emulsion.

In respect of handling, the mixture (2) may contain water and when applicable, contains water preferably in an amount of 5 to 80 weight % based on the total amount of the emulsion, thus enabling regulation of viscosity. Further, a part of the aqueous solution mixture (1) may be incorporated into the mixture (2).

The compounding ratio of the aqueous solution (1) to the mixture (2), that is, the aqueous solution (1)/mixture (2), is preferably 50/50 to 10/90.

In the present invention, the mode for mixing/emulsifying the aqueous solution mixture (1) with the mixture (2), there is a method (i) wherein the mixture (2) and a part of the aqueous solution mixture (1) are previously charged into a mixing bath, and the remainder of the aqueous solution mixture (1) is added intermittently in portions or added continuously (by e.g. dropwise addition) or a method (ii) wherein the mixture (2) is previously charged into a mixing bath, and the whole of the aqueous solution mixture (1) is added intermittently in portions or added continuously (by e.g. dropwise addition). In the method of either intermittent addition in portions or continuous addition (for example dropwise addition), the emulsion may be supplemented with at least one member selected from water, the surfactant (b) and the emulsifying agent (c).

When the mixture (2) contains water, the solid water-soluble inorganic salt (a) can be added to, and dissolved in, the mixture (2) thereby salting out the surfactant (b). The amount of the water-soluble inorganic salt (a) in this case is added to the solids content of the aqueous solution (1), and can be determined in accordance with the case where the water-soluble inorganic salt (a) is added as the aqueous solution (1).

The mixing means in the present invention can make use of generally known mixing means such as a batch mixing, a continuous mixing, a semi-batch mixing or a combination thereof. Particularly, a bath stirring device having a stirrer is preferable. Particularly, a stirring device capable of efficiently dispersing the hydrophilic powder (d) is preferable, and a generally used mixing bath having a stirring blade such as a stirring blade of paddle, propeller, turbine or disper type is preferable from the viewpoint of reducing the burden on facilities. When a stirring device having a high peripheral speed, such as a homo mixer, is used in the process of the present invention, the emulsion can be produced for in a very short time. When the viscosity of the emulsion is high, a stirring blade of ribbon, anchor or gate type, effective for a high viscosity, is preferably used. When the viscosity of the emulsion is low or a vigorous vortex is generated by stirring buffer plate for preventing the vortex is preferably used. For improving the mixed state in the bath, external circulation or the like may be carried out. A static disperser such as a static mixer may be arranged in an external circulating unit. Without using a stirring blade, the respective components can be mixed and emulsified by shearing with a static disperser in an external circulating unit or with a centrifugal pump for circulation.

The stirring conditions are varied depending on the degree of micronization of required liquid droplets, and when micronization into particularly fine liquid droplets is required, the liquid droplets can be micronized by prolonging the stirring time at the concentration of the electrolyte at which emulsification proceeds, by increasing the peripheral speed of a stirring blade, or by decreasing the rate of adding the water-soluble inorganic salt (a) and/or the aqueous solution (mixture(1)) containing the same, and by changing stirring conditions in this way, the liquid droplets can have a diameter regulated as desired. The stirring peripheral speed is varied depending on the size of the compounding bath and the diameter of a stirring blade, but in consideration of the rheological physical properties of the emulsion, the peripheral speed is preferably selected in the range of about 0.5 to 25 m/s.

The average particle diameter of emulsified liquid droplets in the emulsion obtained by the process of the present invention is preferably 0.1 to 10 μm. The viscosity of the emulsion is preferably 100 to 3000 mPa·s. The average particle diameter of the emulsified liquid droplets and the viscosity of the emulsion are values which may be determined by methods described in the following examples.

EXAMPLES

The invention will be explained below in detail in line with examples. No limitation is made to the invention with the examples.

Hereinafter, the term "%" in Examples and Comparative Example refers to % by weight unless otherwise specified.

In the following examples, the respective components shown in Table 1 were used in the composition shown in Table 1 to give an emulsion for liquid detergent.

TABLE 1

| Component | weight-% |
|---|---|
| Anionic surfactant *1 | 1.1 |
| Nonionic surfactant *2 | 21.1 |
| Emulsifying polymer *3 | 1.1 |
| Propylene glycol | 2.9 |

TABLE 1-continued

| Component | weight-% |
|---|---|
| Ethylene glycol | 2.1 |
| Citric acid | 0.8 |
| Zeolite *4 | 21.1 |
| Potassium carbonate | 15.8 |
| sodium polyacrylate *5 | 0.5 |
| Ion-exchanged water | balance |

*1 Anionic surfactant: Lunac L-55 manufactured by Kao Corporation
*2 Nonionic surfactant having about 7 moles of ethylene oxide (EO) added to a C12 to C14 secondary alcohol
*3 Emulsifying polymer: a polyethylene glycol monomethacrylate (number of moles of EO on average, 90)/methacrylic acid = 50/50 (weight ratio) copolymer (weight-average molecular weight of 50,000 [polyethylene glycol equivalent MW] determined by GPC)
*4 Zeolite: A-type zeolite manufactured by Zeobuilder (median diameter 3.8 μm)
*5 sodium polyacrylate; weight-average molecular weight of 15,000 [polyethylene glycol equivalent MW] determined by GPC)

<Method of Measuring the Average Particle Diameter of the Emulsified Liquid Droplets>

9 g of 49% aqueous potassium carbonate solution and 1 g of the resulting emulsion were introduced into a 8.2 mL centrifuge tube and dispersed by slight stirring and then separated by centrifugation into the emulsified liquid droplets and zeolite (high-speed centrifuge CR-22G, 800 rpm, 5 minutes, atmosphere at 20° C., manufactured by Hitachi, Ltd.) The emulsified liquid droplets in the upper layer were diluted with 49% aqueous potassium carbonate solution and examined for the particle-diameter distribution and average particle diameter on a weight basis by a laser diffraction/scattering particle-size distribution measuring instrument (LA910 using a batch cell, manufactured by Horiba, Ltd.).

<Method of Measuring the Viscosity of the Emulsion>

200 g emulsion was charged into a 200-mL beaker and measured for its viscosity by a Brookfield viscometer (manufactured by Tokyo Keiki) with Rotor No. 3 under the condition of a rate of 60 r/min. (20° C.).

Example 1

0.3 kg composition in Table 1 was compounded in a 0.5-L separable flask having 4 pitched paddles arranged therein. First, the anionic surfactant, the nonionic surfactant, propylene glycol, ethylene glycol, the emulsifying polymer, 49% aqueous potassium carbonate solution (1.6% in terms of the content of pure potassium carbonate) and ion-exchange water were charged into the flask and mixed under a peripheral speed of 1 m/s, and zeolite was added thereto and dispersed. Thereafter, the remainder of the 49% aqueous potassium carbonate solution (14.2% in terms of the content of pure potassium carbonate) was introduced at 5.8 g/min., and then sodium aqueous citric acid solution were added thereto and mixed for 5 minutes. The average particle diameter of emulsified liquid droplets in the resulting emulsion for liquid detergent was 1.6 μm, and the viscosity of the emulsion was 460 mPa·s.

Comparative Example 1

The same compounding and operation as in Example 1 were carried out except that zeolite was added after the whole of 49% aqueous potassium carbonate solution was introduced. The average particle diameter of emulsified liquid droplets in the resulting emulsion for liquid detergent was 3.6 μm, and the viscosity of the emulsion was 900 mPa·s.

Example 2

The same compounding and operation as in Example 1 were carried out except that the stirring blade in Example 1 was changed into a disper blade (TK Robomix manufactured by Tokushu Kika Kogyo Co., Ltd.), and the stirring peripheral speed after introduction of zeolite was changed to 3 m/s. The average particle diameter of emulsified liquid droplets in the resulting emulsion for liquid detergent was 0.8 μm, and the viscosity of the emulsion was 350 mPa·s.

Example 3

2.0 kg composition in Table 1 was compounded in a 2 L mixing bath having 4 pitched paddles arranged therein. The same compounding and operation as in Example 1 were carried out except that zeolite having a median diameter of 8 μm was used, the peripheral speed after addition of zeolite was increased to 2.2 m/s, and 49% aqueous potassium carbonate solution was added at a rate of 16.8 g/min. The average particle diameter of emulsified liquid droplets in the resulting emulsion for liquid detergent was 0.9 μm, and the viscosity of the emulsion was 390 mPa·s.

Example 4

12.8 kg composition in Table 1 was compounded in a 20 L mixing bath having 4 pitched paddles arranged on 2 stages therein. The same compounding and operation as in Example 1 were carried out except that after addition of zeolite in Example 1, the peripheral speed was increased to 2 m/s, and 0.50 kg of 49% aqueous potassium carbonate solution was added in one portion, then 1.29 kg of 49% aqueous potassium carbonate solution was added continuously at a rate of 15.5 g/min., and then the remainder was added in one portion. The average particle diameter of emulsified liquid droplets in the resulting emulsion for liquid detergent was 1.2 μm, and the viscosity of the emulsion was 380 mPa·s.

Example 5

12.8 kg composition in Table 1 was compounded in a 20 L mixing bath having 4 pitched paddles arranged on 2 stages therein. The same compounding and operation as in Example 1 were carried out except that after addition of zeolite in Example 1, the peripheral speed was increased to 4 m/s, and 0.50 kg of 49% aqueous potassium carbonate solution was added in one portion, then 1.29 kg of 49% aqueous potassium carbonate solution was added continuously at a rate of 15.5 g/min., and then the remainder was added in one portion. The average particle diameter of emulsified liquid droplets in the resulting emulsion for liquid detergent was 0.7 μm, and the viscosity of the emulsion was 350 mPa·s.

Example 6

12.8 kg composition in Table 1 was compounded in a 20 L mixing bath having 4 pitched paddles arranged on 2 stages therein. The same compounding and operation as in Example 1 were carried out except that after addition of zeolite in Example 1, the peripheral speed was increased to 2 m/s, and 0.57 kg of 49% aqueous potassium carbonate solution was in one portion and stirred for about 60 minutes, and then the remainder (3.16 kg) was added in one portion. The average particle diameter of emulsified liquid droplets in the resulting emulsion for liquid detergent was 0.7 μm, and the viscosity of the emulsion was 460 mPa·s.

Example 7

The same compounding and operation as in Example 6 were carried out except that the amount of sodium polyacrylate was 3.0% and the amount of the emulsifying polymer was 0.5% in Table 1. The average particle diameter of emulsified liquid droplets in the resulting emulsion for liquid detergent was 0.8 μm and the viscosity of the emulsion was 480 mPa·s.

The invention claimed is:

1. A process for producing an emulsion, comprising adding a mixture (1) comprising a water-soluble inorganic salt (a) which comprises potassium carbonate and/or an aqueous solution comprising the potassium carbonate to a mixture (2) comprising a surfactant (b) which comprises a mixture of anionic surfactant and nonionic surfactant, a surfactant-emulsifying agent (c) which comprises a copolymer of polyethylene glycol monomethacrylate and methacrylic acid for emulsifying the surfactant (b), and a hydrophilic powder (d) which comprises a zeolite, and mixing mixtures (1) and (2) to emulsify the surfactant (b), wherein surfactant-emulsifying agent (c) is such that when a composition containing 20 weight % of the surfactant (b), 30 weight % potassium carbonate, 5 weight % of the surfactant-emulsifying agent (c) and the balance, water, is shaken in a transparent bottle for 1 minute at room temperature and left at room temperature for 3 minutes, the composition remains opaque in an emulsified state.

2. The process according to claim 1, wherein the mixture (2) further comprises water.

3. The process according to claim 1 or 2, wherein the mixing step is performed using a stirrer attached with mixing bath.

4. The process according to claim 1 or 2, wherein the hydrophilic powder (d) has a particle diameter of 20 μm or less in terms of the diameter of secondarily agglomerated particles.

5. The process according to claim 1 or 2, wherein the hydrophilic powder (d) has a particle diameter of 1 μm or more.

6. The process according to claim 2, wherein water is present in an amount of 5 to 80 wt %, by weight of the emulsion.

7. The process according to claim 6, wherein the aqueous solution comprising the water-soluble inorganic salt (a) is present, and the weight ratio of said aqueous solution to mixture (2) is from 50/50 to 10/90.

8. The process according to claim 1, wherein water-soluble inorganic salt (a) is present in an amount of 4 to 50 wt %, surfactant (b) is present in an amount of 5-80 wt %, surfactant-emulsifying agent (c) is present in an amount of 0.01-10 wt %, and hydrophilic powder (d) is present in an amount of 5-50 wt %, all percentages by weight of the emulsion.

9. The process according to claim 8, wherein water-soluble inorganic salt (a) is present in an amount of 5 to 32 wt %, surfactant (b) is present in an amount of 10-60 wt %, surfactant-emulsifying agent (c) is present in an amount of 0.1-5 wt %, and hydrophilic powder (d) is present in an amount of 10-40 wt %, all percentages by weight of the emulsion.

10. The process according to claim 8, wherein water-soluble inorganic salt (a) is present in an amount of 6 to 20 wt % and surfactant (b) is present in an amount of 20-60 wt %, all percentages by weight of the emulsion.

* * * * *